US005197661A

United States Patent [19]

Sanchez

[11] Patent Number: 5,197,661

[45] Date of Patent: Mar. 30, 1993

[54] SEE-THROUGH STORAGE CONTAINER

[76] Inventor: Martha L. Sanchez, 41-07 Bowne St.; Apt. 4A, Flushing, N.Y. 11355

[21] Appl. No.: 893,032

[22] Filed: Jun. 3, 1992

[51] Int. Cl.[5] ..... B65D 5/42

[52] U.S. Cl. ..... 229/162; 206/45.31; 206/45.34; 229/117.25

[58] Field of Search ..... 206/45.31, 45.34, 8, 206/278, 299; 229/162, 117.24, 117.25

[56] References Cited

U.S. PATENT DOCUMENTS

| | | | |
|---|---|---|---|
| 1,154,457 | 9/1915 | Taylor | 206/8 |
| 1,623,715 | 4/1927 | Berkowitz | 206/8 |
| 2,141,839 | 12/1938 | Hokerk | 206/45.34 |
| 2,143,957 | 1/1939 | Petter | 206/45.34 |
| 2,176,955 | 10/1939 | Clow | 206/45.34 |
| 2,233,704 | 3/1941 | Hohl et al. | 206/45.34 |
| 2,269,201 | 1/1942 | Hokert | 206/45.34 |
| 2,283,046 | 5/1942 | Clouston | 206/45.34 |
| 2,989,226 | 6/1961 | Swartz | 229/162 |
| 3,008,568 | 11/1961 | Van Doren | 206/8 |
| 3,276,671 | 10/1966 | Fleitman | 206/45.34 |
| 3,799,428 | 3/1974 | Lamming | 206/45.34 |
| 4,166,529 | 9/1979 | Adamek | 206/45.34 |
| 4,697,718 | 10/1987 | Butcher et al. | 206/45.34 |
| 4,733,916 | 3/1988 | Seufert | 206/45.34 |
| 5,031,826 | 7/1991 | Seufert | 206/45.34 |

FOREIGN PATENT DOCUMENTS

| | | | |
|---|---|---|---|
| 279754 | 8/1988 | European Pat. Off. | 229/162 |
| 708460 | 7/1931 | France | 206/45.34 |
| 1211743 | 3/1960 | France | 206/45.34 |
| 695017 | 8/1953 | United Kingdom | 206/8 |
| 1539870 | 2/1979 | United Kingdom | 206/45.34 |

*Primary Examiner*—Gary E. Elkins
*Attorney, Agent, or Firm*—Michael I. Kroll

[57] ABSTRACT

An improved see-through storage container is provided which consists of a housing for holding at least one article therein. A structure on a portion of the housing is for transmitting light, so that the at least one article can be seen within the housing as if there is no intervening material. A mechanism is provided for covering the housing to protect the at least one article.

2 Claims, 2 Drawing Sheets

SEE-THROUGH STORAGE CONTAINER

BACKGROUND OF THE INVENTION

1. Field of the Invention

The instant invention relates generally to boxes for storing wearing apparel and more specifically it relates to an improved see-through storage container.

2. Description of the Prior Art

Numerous boxes for storing wearing apparel have been provided in prior art that are adapted to retain the wearing apparel for subsequent use and retrieval at a later period of time, so that the wearing apparel can be worn on the person. While these units may be suitable for the particular purpose to which they address, they would not be as suitable for the purposes of the present invention as heretofore described.

SUMMARY OF THE INVENTION

A primary object of the present invention is to provide an improved see-through storage container that will overcome the shortcomings of the prior art devices.

Another object is to provide an improved see-through storage container which includes a transparent segment, so that a person can see an item within the container, instead of having to open the container.

An additional object is to provide an improved see-through storage container that is made especially for the person to immediately identify an item within the container, when the container is stored and stacked with other containers on a shelf within a closet, storage room and the like.

A further object is to provide an improved see-through storage container that is simple and easy to use.

A still further object is to provide an improved see-through storage container that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
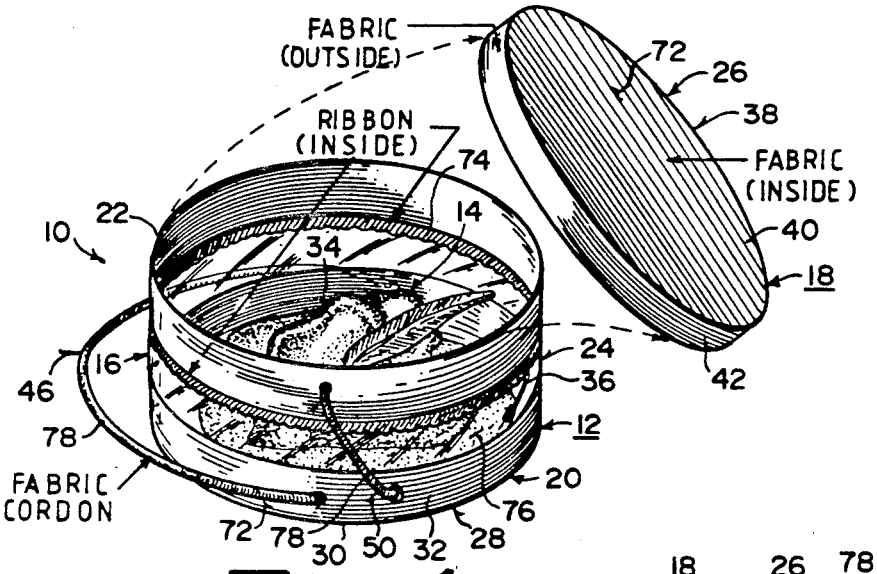
FIG. 1 is a perspective view of a first embodiment of the instant invention being a hat box with the lid exploded therefrom.

Turning now descriptively to the drawings, in which similar reference characters denote similar elements throughout the several views, the Figures illustrate an improved see-through storage container 10, which consists of a housing 12 for holding at least one article 14 therein. A structure 16 on a portion of the housing 12 is for transmitting light, so that the at least one article 14 can be seen within the housing 12, as if there is no intervening material. A mechanism 18 is provided for covering the housing 12 to protect the at least one article 14.

The housing 12 is a receptacle 20 having an open top 22, so that the at least one article 14 can be inserted within the receptacle 20. The light transmitting structure 16 is a transparent segment 24 on the receptacle to allow a person to look within an see the at least one article without having to remove the covering means from the receptacle. The covering mechanism 18 is a lid 26 to be removably placed upon the open top 22 of the receptacle 20.

Figure 2:
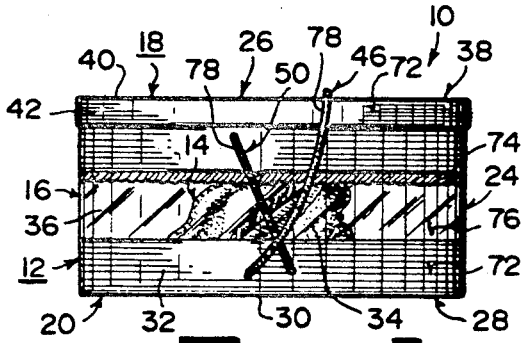
FIG. 2 is an elevational view thereof.
Figure 3:
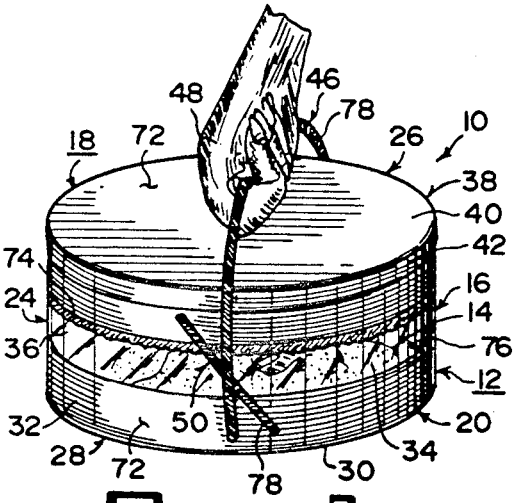
FIG. 3 is a perspective view showing the hat box being carried horizontally.
Figure 4:
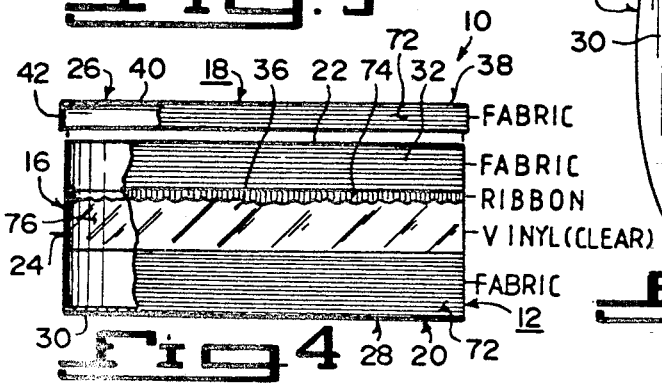
FIG. 4 is an elevational view with the lid exploded therefrom and parts broken away and in section.
Figure 5:
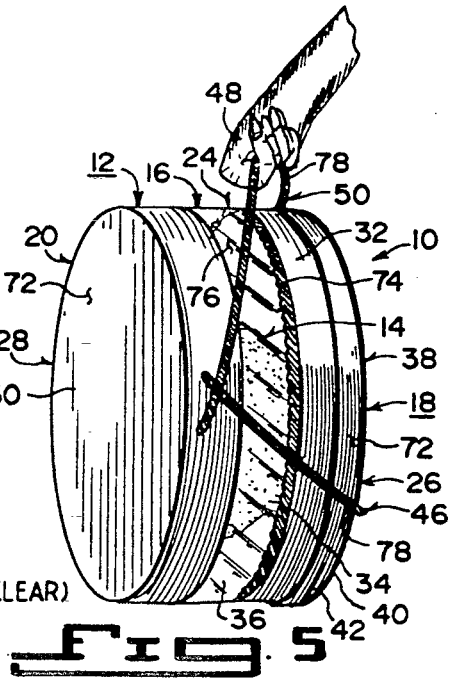
FIG. 5 is a perspective view showing the hat box being carried vertically.

The receptacle 20 in FIGS. 1 through 5, is a round box 28 that includes a disc-shaped bottom wall 30 and an upwardly extending circular side wall 32 to hold the at least one article 14 therein, which is a hat 34. The transparent segment 24 is a clear band 36 extending about the center of the side wall 32 of the round box 28. The lid 26 is a round cover 38 that includes a disc-shaped top wall 40 and a downwardly extending annular flange 42 to fit over an upper edge of the annular flange 42 to fit over the side wall 32 of the round box 28.

A device 44 can be provided on the side wall 32 for carrying the round box 28 from place to place. The carrying device 44 is an elastic cord 46 having each end affixed opposite to the side wall 32 of the round box 28, so that a person can grip by a hand 48 the elastic cord 46 to carry the round box 28 horizontally. The carrying device 44 can further include a second elastic cord 50 having each end affixed on a same side of the side wall 32 diagonally across the clear band 36. The person can grip by the hand 48 the second elastic cord 50 to carry the round box 28 vertically with the first elastic cord 46 retaining the round cover 38 thereto.

Figure 6:
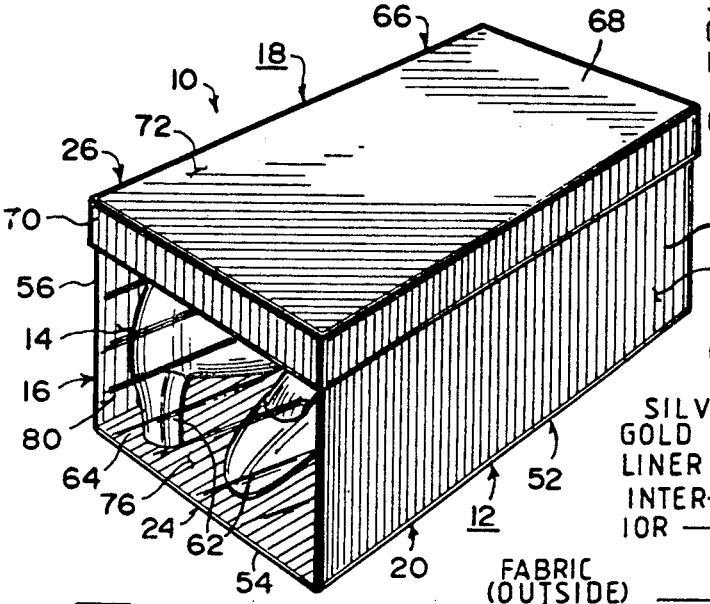
FIG. 6 is a perspective view of a second embodiment of the instant invention being a shoe box.
Figure 8:
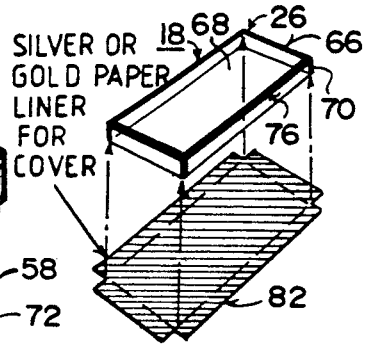
FIG. 8 is an exploded perspective view showing the liner and lid of the shoe box.
Figure 9:
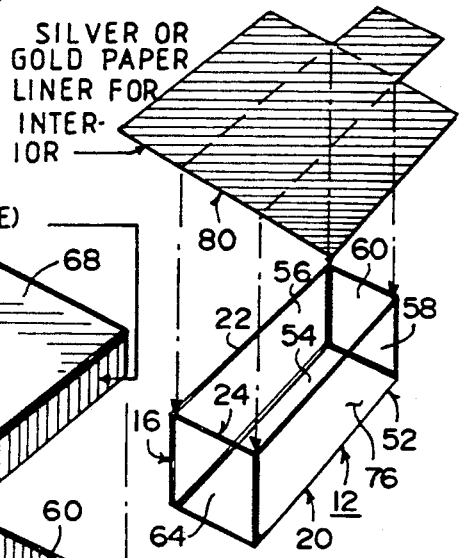
FIG. 9 is an exploded perspective view showing the liner and receptacle of the shoe box.
Figure 7:
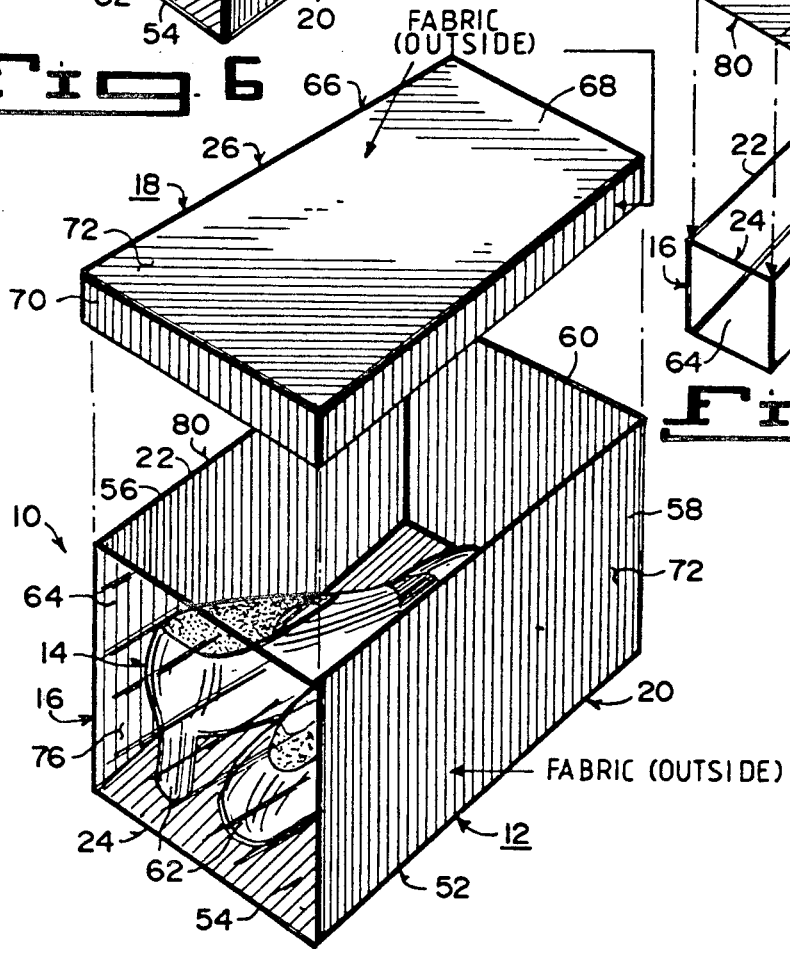
FIG. 7 is a perspective view of the shoe box with the lid exploded therefrom.

The receptacle 20 in FIGS. 6 through 9 is a rectangular box 52 that contains a rectangular bottom wall 54, an upwardly extending rectangular rear wall 56, an upwardly extending rectangular front wall 58 and an upwardly extending square side wall 60 to hold the at least one article 14 therein, which is a pair of shoes 62.

The transparent segment 24 is an upwardly extending clear square side wall 64 opposite from the upwardly extending square side wall on the rectangular box 52.

The lid 26 is a rectangular cover 66 that consists of a rectangular top wall 68 and a downwardly extending rectangular shaped flange 70 to fit over an upper edge of the rear wall 56, the front wall 58, the side wall 60 of the rectangular box 52 and the clear side wall 64.

The enhance the appearance of the storage container 10 in FIGS. 1 through 5, the bottom wall 30 and the side wall 32 of the round box 28 can be covered with fabric 72 of the matching color. A ribbon 74 can be secured on the inside between the clear band and an upper portion of the side wall 32. The clear band 36 can be made of a transparent plastic material 76, while the round cover 38 can also be covered with the fabric 72. The first elastic cord 46 and the second elastic cord 50 can both be made out of a fabric cordon 78.

To enhance the appearance of the storage container 10 in FIGS. 6 through 9, the rectangular box 5, the clear square side wall 64 and the rectangular cover 66, can all be made out of the transparent plastic material 76. A silver or gold paper liner 80 can then be secured to the interior of the rectangular box 52 and not to the clear square side wall 64. A silver or gold paper liner 82 can then be also secured to the interior of the rectangular cover 66. The exterior of the rectangular box 52 and the rectangular cover 66 are then covered with the matching fabric 72.

LIST OF REFERENCE NUMBERS 10 improved see-through storage container
12 housing
14 article
16 light transmitting structure
18 covering mechanism
20 receptacle for 12
22 open top in 20
24 transparent segment for 16
26 lid for 18
28 round box for 20
30 disc-shaped bottom wall in 28
32 circular side wall in 28
34 hat for 14
36 clear band for 24
38 round cover for 26
40 disc-shaped top wall in 38
42 annular flange in 38
44 carrying device
46 first elastic cord
48 hand
50 second elastic cord
52 rectangular box for 20
54 rectangular bottom wall in 52
56 rectangular rear wall in 52
58 rectangular front wall in 52
60 square side wall in 52
62 pair of shoes for 14
64 clear square side wall for 24
66 rectangular cover for 26
68 rectangular top wall in 66
70 rectangular shaped flange in 66
72 fabric
74 ribbon
76 transparent plastic material
78 fabric cordon It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved see-through storage container which comprises:

a) means for holding at least one article therein; said holding means comprising a receptacle having an open top, so that the at least one article can be inserted within the receptacle, said receptacle being a round box with a disc-shaped bottom wall and an upwardly extending circular side wall to hold the at least one article therein which is a hat;

b) means on a portion of said holding means for transmitting light, so that the at least one article can be seen within said holding means as if there is no intervening material, said means for transmitting light comprising a clear band extending about a center of said side wall of said round box;

c) means for covering said holding means to protect the at least one article, said covering means comprising a lid to be removably placed upon the open top of said receptacle, said lid being a round cover including a disc-shaped top wall and a downwardly extending annular flange to fit over an upper edge of said side wall of said round box; and d) means on said side wall for carrying said round box from place to place, said carrying means including a first elastic cord having each end affixed oppositely to said side wall of said round box and a second elastic cord having each end affixed on a same side of said side wall diagonally across said clear band, so that a person can grip by hand said first elastic cord to carry said round box horizontally and so that the person can grip by the hand said second elastic cord to carry said round box vertically with said first elastic cord retaining said round cover thereto.

2. An improved see-through storage container as recited in claim 1, wherein said light transmitting means is a transparent segment on said receptacle to allow a person to look within sand see the at least one article without having to remove said covering means from said receptacle.

* * * * *